United States Patent [19]

Sievers

[11] Patent Number: 4,486,019

[45] Date of Patent: Dec. 4, 1984

[54] COMBINATION GOLF PUTTER AND RETRIEVER

[76] Inventor: Paul T. Sievers, 986 Fenworth Blvd., Franklin Square, N.Y. 11010

[21] Appl. No.: 447,236

[22] Filed: Dec. 6, 1982

[51] Int. Cl.[3] ..... A63B 53/04

[52] U.S. Cl. ..... 273/162 E; 273/167 C

[58] Field of Search ..... 273/162 E, 167 C, 32 F, 273/169; 294/19 A

[56] References Cited

U.S. PATENT DOCUMENTS 4,147,357 4/1979 Strop ..... 273/162 E 4,361,329 11/1982 Brock ..... 273/162 E

FOREIGN PATENT DOCUMENTS 23018 of 1905 United Kingdom ..... 273/167 C

*Primary Examiner*—George J. Marlo

[57] ABSTRACT

A combination putter and golf ball retriever has a striking face on one side of a head and a cup-shaped depression in the second side. The striking side is generally planar and has a perimeter which is symmetrical to a line parallel to the axis of a shaft. The symmetry permits use by either right- or left-handed golfers and makes putting use independent of the shaft angle with respect to the slope of the surface. The cup-shaped retriever side permits retrieving a ball from a hole without bending over. A central depression in the lip of the cup-shaped retriever side permits the lip to pass below the equator of a ball in the hole for engagement with, and lifting, the ball.

1 Claim, 8 Drawing Figures

COMBINATION GOLF PUTTER AND RETRIEVER

BACKGROUND OF THE INVENTION

The present invention is related to sporting apparatus and, more particularly, to sporting apparatus associated with the game of golf and the like.

The game of golf is played using three varieties of clubs for the three portions of the game. In the first portion, the golfer attempts to drive the ball a substantial distance off a tee. For this purpose, the golfer uses a driver or a club with a metal head especially adapted for achieving distance. Usually, the drive positions the golf ball in a lie intermediate the tee and the green. From this intermediate position, the golfer attempts to hit the ball onto the green. For this purpose, various clubs adapted for distance, height and spin are used. When the ball reaches the green, the golfer employs a putter to accurately, it is hoped, launch the golf ball to the cup. When the golf ball falls in the cup, the golfer must bend over to retrieve it.

Putting is normally performed with a putter which includes a metallic head attached to a shaft. Conventionally, a putter has a generally flat sole which is inclined at a predetermined angle from the shaft. This requires that the shaft be swung at a predetermined angle so that the flat sole of the putter head can move parallel to the surface to strike the ball with a face which is located at one side of the head. On sloping ground, for example, in order to maintain the sole parallel to the sloping ground, the shaft must be inclined at a greater angle than is natural or convenient for the golfer.

As is well known, some people perform best as right handers and others perform best as left handers. It is estimated that approximately 10 percent of golfers are left-handed. Right-handed and left-handed golfers require different clubs due to the angle between the sole of the head and the axis of the shaft. Thus, separate right- and left-hand molds must be provided by a club manufacturer in order to satisfy the right-hand and left-hand market. Since the left-hand market is considerably smaller than the right-hand market, certain lines of golf clubs are unavailable to left-handed golfers.

For a large number of golfers, it is inconvenient, and sometimes impossible, to stoop or bend to pick up a golf ball due to age, stiffness or physical infirmity. This problem is further aggravated in attempting to retrieve a ball from a hole because the ball is in a position depressed several inches below the surface on which the golfer is supported. In response to this problem, some golfers have employed their putter to attempt to fish out the ball from the hole. A normal putter is ill shaped for this task and is usable in this way only by pressing the ball against the side of the hole and riding it upward until it emerges.

The above method of retrieving a golf ball from a hole with a putter does damage to the hole which is at least partly unprotected dirt. The dirt is abraded by the putter and the ball being dragged across it and tends to degrade the smoothness and desirable evenness of the hole.

OBJECTS AND SUMMARY OF THE INVENTION

Accordingly, it is an object of the invention to provide a putter which is equally usable by left- and right-handed golfers.

It is a further object of the invention to provide a retriever for retrieving a golf ball from a hole without bending over.

It is a still further object of the invention to provide a combined putter and retriever which overcomes the drawbacks of the prior art.

It is a further object of the invention to provide a combination putter and retriever having a face adapted for striking a golf ball and a cup shaped portion adapted for cradling and lifting a golf ball from a hole.

It is a further object of the invention to provide a head for a combination putter and retriever wherein the head has a striking face for striking a golf ball and a cup shaped face for cradling and supporting a golf ball so that it can be raised.

According to an aspect of the present invention, there is provided a golf putter, comprising a head, a shaft affixed to the head, a striking face on the head, the striking face being symmetrical about a center line parallel to an axis of the shaft, and the face having a curved perimeter effective to permit striking a ball independently of a slope of a surface upon which the ball rests and independent of an angle made by the axis with the surface.

According to a feature of the present invention there is provided a golf ball retriever, comprising a head, a shaft affixed to the head, a cup side in the head, the cup side having a lip, the lip being effective to support a golf ball in the cup side at angles of an axis of the shaft exceeding a predetermined amount from a vertical, the head being sized to permit insertion into a golf green hole, the lip containing means for permitting the lip to pass below an equator of a golf ball in the golf green hole, and the lip and cup stably supporting the golf ball for removal from the golf green hole.

According to a further feature of the present invention, there is provided a combination golf putter and retriever, comprising a head, a shaft affixed to the head, a striking face on a first side of the head, the striking face being symmetrical about a center line parallel to an axis of the shaft, the face having a curved perimeter effective to permit striking a ball independently of a slope of a surface upon which the ball rests and independent of an angle made by the axis with the surface, a cup in a second side of the head, the cup having a part spherical inner contour, the inner contour having a radius substantially equal to a radius of the golf ball, the cup being at least partially surrounded by a lip, the lip being effective to support a golf ball in the cup at angles of an axis of the shaft exceeding a predetermined amount from a vertical, the head being sized to permit insertion into a golf green hole, the lip containing means for permitting the lip to pass below an equator of a golf ball in the golf green hole, and the lip and cup stably supporting the golf ball for removal of the golf ball from the golf green hole.

The above, and other objects, features and advantages of the present invention will become apparent from the following description read in conjunction with the accompanying drawings, in which like reference numerals designate the same elements.

DETAILED DESCRIPTION OF THE PREFERRED EMBODIMENT

Figure 1:
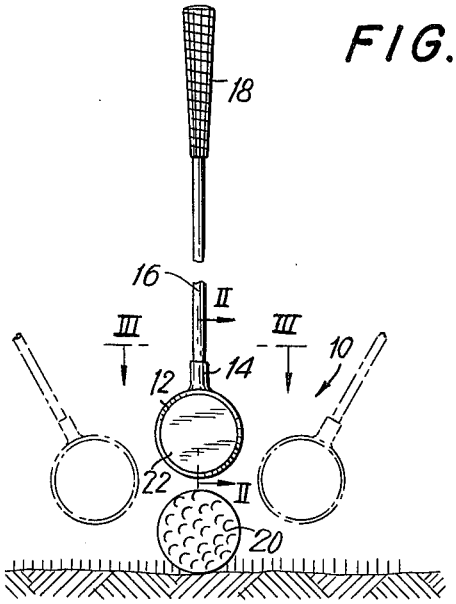
FIG. 1 is a side view of a combination putter and retriever according to an embodiment of the invention.

Referring now to FIG. 1, a combination putter and retriever 10 is shown employed as a putter. Combination putter and retriever 10 includes a head 12 with a ferrule 14 preferably integrally formed therewith. A shaft 16 of a conventional type is affixed in ferrule 14 and terminates in a conventional hand grip 18.

Combination putter and retriever 10 is shown in its use as a putter for putting a conventional golf ball 20. Head 12 is seen to be symmetrical about a center line which is an extension of an axis of shaft 16. Head 12 has a generally oval or elliptical shape. Thus, combination putter and retriever 10 can be used as a putter in the upright position shown in solid line or in the right- or left-hand angular positions shown in dashed line. Thus, combination putter and retriever 10 can be used as a putter by either a right- or a left-handed player and may be employed with substantially any shaft angle which the lie of golf ball 20 requires. This is in decided contrast to putters of the prior art in which a predetermined angle is established between an axis of shaft 16 and a generally flat sole plate of a head. Thus, the putters of the prior art not only cannot be used at variable angles, but also, separate clubs must be purchased by left- and right-handed players.

Figure 2:
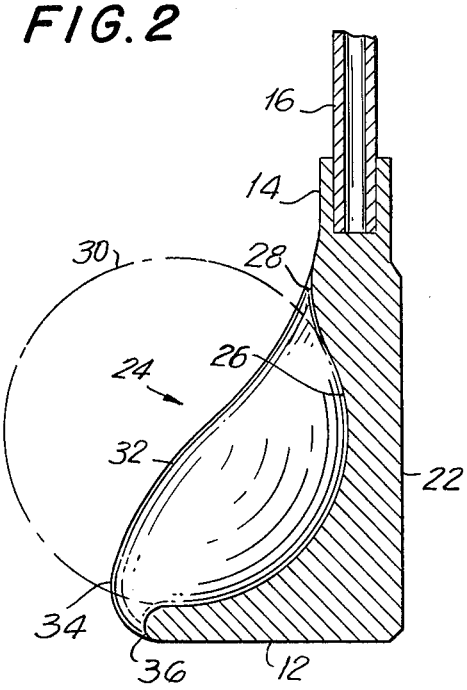
FIG. 2 is a cross section of the combination putter and retriever taken along II—II of FIG. 1.

Referring now to FIG. 2, head 12 is seen to include a face side 22 for use in putting and a cup side 24 for use in retrieving. Face side 22 has a relatively flat face generally parallel with an axis of shaft 16 for impacting a golf ball during putting. Cup side 24 includes a depression 26 which begins at a ridge 28 and follows a contour generally shaped to accommodate a golf ball profile shown in dashed line 30. A lip 32 rises from ridge 28 to a lateral peak 34 and then descends to a central depression 36.

Figure 3:
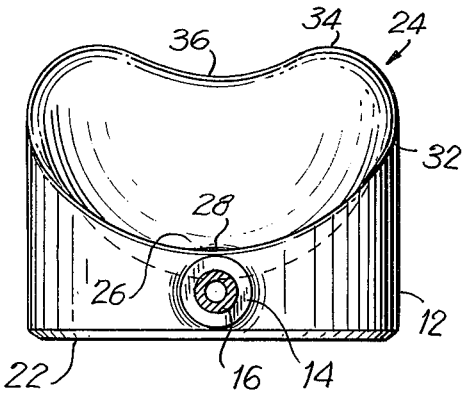
FIG. 3 is a cross section of a combination putter and retriever taken along III—III of FIG. 1.
Figure 4:
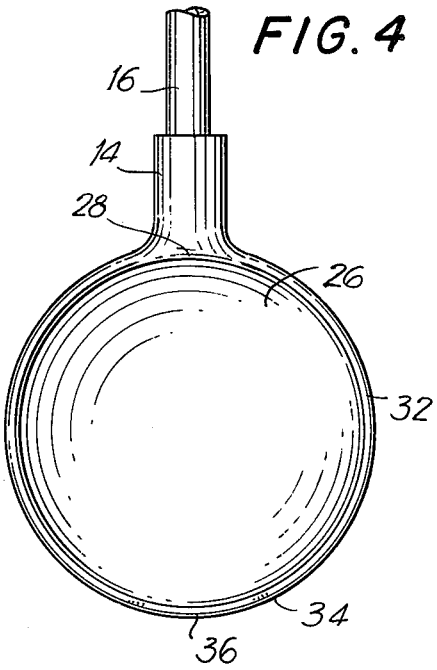
FIG. 4 is a side view of a combination putter and retriever according to the present invention showing the cup shaped retriever side.

Referring now also to FIGS. 3 and 4, central depression 36 in lip 32 has a profile in a plane normal to the axis of shaft 16 which includes a radius approximately equal to the radius of a golf ball.

Figure 5:
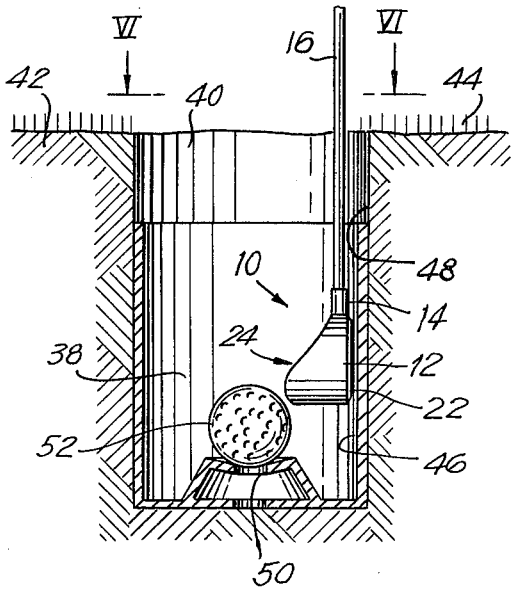
FIG. 5 is a cross section of a hole showing a combination putter and retriever at one stage of retrieving a ball from the hole.

Referring now to FIG. 5, there is shown a typical hole 38 in a green of a golf course. Hole 38 is formed as a cylindrical opening 40 in earth 42 of a golfing green which is advantageously covered with grass or sod 44. A metal cup 46 lines a lower portion of opening 40 leaving an upper portion of bare earth. A butt socket 50 is conventionally provided for supporting the staff of a flag (not shown).

When a golf ball 52 is putted into hole 38, it comes to rest at the bottom and most often rests upon butt socket 50. In order to raise golf ball 52 from hole 40, head 12 of combination putter and retriever 10 is lowered into cup 46 with face side 22 closest to an inside surface of cup 46 and with cup side 24 of head 12 facing golf ball 52.

Figure 6:
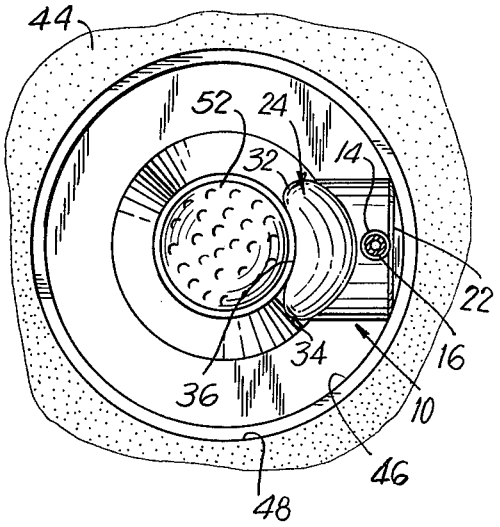
FIG. 6 is a cross section taken along VI—VI of FIG. 5.

Referring now also to FIG. 6, as head 12 is lowered into cup 46, central depression 36 in lip 32 provides relief for head 12 to slide past golf ball 52 until lateral peaks 34 are located below an equator of golf ball 52.

Figure 7:
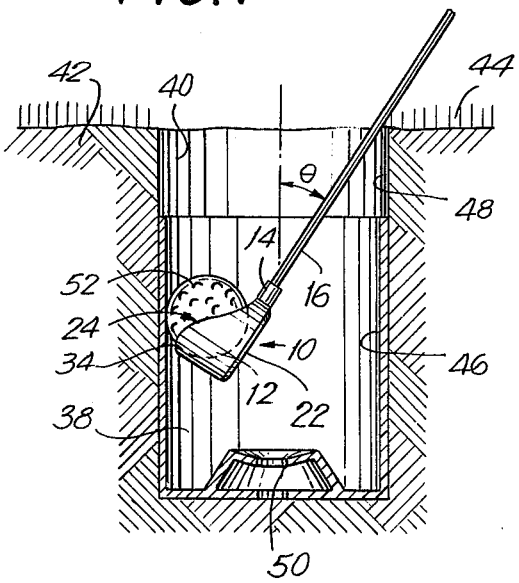
FIG. 7 is a cross section of a hole showing a further stage in retrieving a golf ball from a hole.

Referring now also to FIG. 7, head 12 is moved toward golf ball 52 until golf ball 52 rests in the partially cylindrical depression formed in cup side 24. At inclination angles $\theta$ of shaft 16 exceeding a predetermined value, golf ball 52 is stably supported in cup side 24 of head 12. Cup side 24 can be shaped to provide stable support at any convenient value of inclination angle $\theta$ including zero degrees, wherein shaft 16 is vertical. In the preferred embodiment, it has been found convenient to employ a cup shape, including the forward extension of lateral peaks 34 which provide a critical angle $\theta$ at which stable support is provided of about 15°. This value of $\theta$ is sufficient to conveniently retrieve golf ball 52 from a conventional hole 38 without stooping or bending over and without abrading unprotected upper portion 48 of hole 38.

Figure 8:
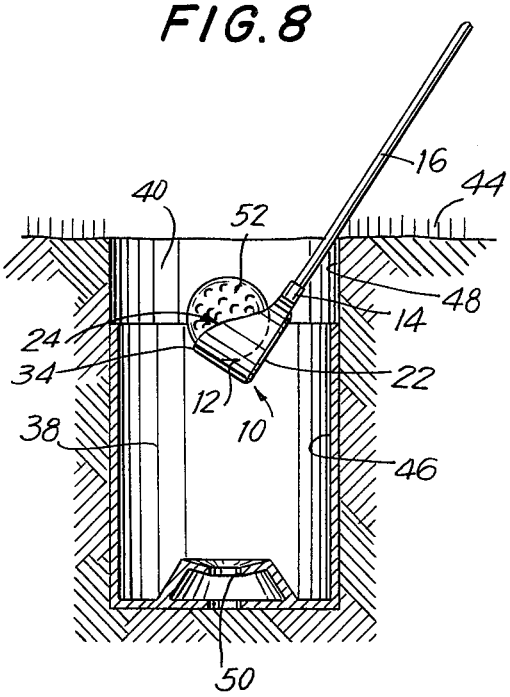
FIG. 8 is a cross section of a hole showing a final stage in retrieving a golf ball from a hole.

FIG. 8 shows golf ball 52 being raised from hole 38. From the preceding, it is seen that combination putter and retriever may be used in an upright position by a golfer as a putter by impacting a golf ball on face side 22 and may also be used as a retriever for raising a golf ball from a hole without bending over by using cup side 24. In addition to these functions, combination putter and retriever may also be employed to pick up a golf ball from a flat or irregular surface, also without bending over. This may be performed by placing cup side 24 alongside a golf ball with central depression 36 low on the perimeter of the golf ball. By moving head 12 forward to tip the golf ball into cup side 24 while increasing angle $\theta$ of shaft 16 until a critical angle $\theta$ is exceeded, the golf ball is securely and stably supported in cup side 24 so that it can be raised without stooping or can be passed to another player also without stooping.

Having described specific preferred embodiments of the invention with reference to the accompanying drawings, it is to be understood that the invention is not limited to those precise embodiments, and that various changes and modifications may be effected therein by one skilled in the art without departing from the scope or spirit of the invention as defined in the appended claims.

I claim:

1. A combination golf putter and retriever, comprising:

a generally circular head;

a shaft affixed to said head;

first and second opposed sides on said head;

a striking face on said first side of said head;

said striking face being symmetrical about a center line parallel to an axis of said shaft;

said face having a first generally circular perimeter effective to permit striking a ball independently of a slope of a surface upon which said ball rests and independent of an angle made by said axis with said surface;

a cup in said second side of said head;

said cup having a second generally circular perimeter substantially coextensive with said first circular perimeter;

said cup having a part spherical inner contour, said inner contour having a radius substantially equal to a radius of said golf ball;

said cup being at least partially surrounded by a lip;

said lip rising to first and second lateral peaks adjacent an extremity of said head remote from said shaft;

said lip being effective to support a golf ball in said cup at angles of an axis of said shaft exceeding a critical angle from a vertical;

said critical angle being at least 15 degrees;

said head being sized to permit insertion into a golf green hole;

said lip containing a central depression therein between said first and second lateral peaks, said central depression providing means for permitting said lip to pass below an equator of a golf ball in said golf green hole; and said lip and cup stably supporting said golf ball for removal of said golf ball from said golf green hole while said angle of said shaft remains greater than said critical angle.

* * * * *